US008769876B2

(12) United States Patent
Albanese et al.

(10) Patent No.: US 8,769,876 B2
(45) Date of Patent: Jul. 8, 2014

(54) WEATHERSTRIP ADAPTED TO BE CAPTURED IN T-SLOTS

(75) Inventors: James V. Albanese, Lyons, NY (US); Daniel W. Richter, Farmington, NY (US)

(73) Assignee: Ultrafab, Inc., Farmington, NY (US)

( * ) Notice: Subject to any disclaimer, the term of this patent is extended or adjusted under 35 U.S.C. 154(b) by 426 days.

(21) Appl. No.: 12/308,313

(22) PCT Filed: Jun. 21, 2006

(86) PCT No.: PCT/US2006/024416

§ 371 (c)(1), (2), (4) Date: Dec. 12, 2008

(87) PCT Pub. No.: WO2007/149088

PCT Pub. Date: Dec. 27, 2007

(65) Prior Publication Data

US 2010/0170160 A1 Jul. 8, 2010

(51) Int. Cl.
*E06B 7/22* (2006.01)

(52) U.S. Cl.
USPC ..... 49/489.1; 49/475.1; 49/495.1

(58) Field of Classification Search
USPC ..... 49/475.1, 489.1, 495.1, 440
See application file for complete search history.

(56) References Cited

U.S. PATENT DOCUMENTS

| | | | | | |
|---|---|---|---|---|---|
| 2,169,504 | A * | 8/1939 | Schlegel | 49/489.1 |
| 2,629,905 | A * | 2/1953 | Kessler et al. | 49/477.1 |
| 3,074,520 | A * | 1/1963 | Grubelich | 403/5 |
| 3,266,190 | A * | 8/1966 | Jackson | 49/489.1 |
| 3,357,137 | A * | 12/1967 | Lombardi et al. | 49/475.1 |
| 3,616,137 | A * | 10/1971 | Horton | 428/88 |
| 3,716,434 | A | 2/1973 | Cook et al. | |
| 3,819,464 | A | 6/1974 | Ungerer | |
| 3,935,043 | A * | 1/1976 | Kessler | 156/72 |
| 4,064,654 | A * | 12/1977 | Olson | 49/489.1 |
| 4,255,902 | A * | 3/1981 | Ruff | 49/482.1 |
| 4,288,482 | A * | 9/1981 | Beck | 428/92 |
| 4,302,494 | A * | 11/1981 | Horton | 428/95 |
| 4,370,833 | A * | 2/1983 | Niemanns | 49/489.1 |
| 4,819,381 | A * | 4/1989 | Kitaura et al. | 49/493.1 |
| 4,970,829 | A * | 11/1990 | Brautigam | 49/489.1 |
| 5,093,181 | A * | 3/1992 | Sanchez | 428/167 |
| 5,111,617 | A * | 5/1992 | Saiga | 49/493.1 |
| 5,123,693 | A * | 6/1992 | Karashima et al. | 296/135 |
| 5,160,187 | A * | 11/1992 | Drumm | 300/21 |
| 5,287,656 | A * | 2/1994 | Johnson | 49/489.1 |
| 5,338,382 | A | 8/1994 | Johnson et al. | |
| 5,438,802 | A * | 8/1995 | Johnson | 49/489.1 |
| 5,807,451 | A | 9/1998 | Johnson | |
| 5,817,390 | A | 10/1998 | Johnson | |
| 6,112,469 | A * | 9/2000 | Vuillemot et al. | 49/498.1 |
| 6,711,858 | B1 * | 3/2004 | Albanese et al. | 49/475.1 |
| 6,776,948 | B1 | 8/2004 | Arvidson et al. | |
| 7,329,450 | B2 * | 2/2008 | Wylie et al. | 428/95 |
| 2002/0168507 | A1 * | 11/2002 | Hope | 428/297.4 |
| 2004/0074719 | A1 * | 4/2004 | Loughney | 188/267.1 |

FOREIGN PATENT DOCUMENTS

GB 2029479 A * 3/1980

* cited by examiner

*Primary Examiner* — Katherine Mitchell
*Assistant Examiner* — Marcus Menezes
(74) *Attorney, Agent, or Firm* — George R. McGuire; Frederick J.M. Price; Bond Schoeneck & King, PLLC

(57) ABSTRACT

A weatherstrip for use with a T-slot. The weatherstrip includes a scaling element, such as a pile of yarn, on one side thereof and a bead on the opposite side thereof. The bead includes a curved surface for engaging an interior surface of the T-slot. Preferably, the bead is a material which adheres to the weatherstrip and comprises a hot melt glue such as ethylene vinyl acetate.

6 Claims, 6 Drawing Sheets

WEATHERSTRIP ADAPTED TO BE CAPTURED IN T-SLOTS

The present invention relates to weatherstripping, and particularly to improved weatherstrips of the type having a backing and a sealing element, such as a pile of yarn extending longitudinally along the backing from one side thereof. The weatherstrip is improved to facilitate insertion and capture thereof into a T-slot.

T-slots in support members, such as frames around windows and doors, are particularly suitable for holding and capturing weatherstrip. Once the weatherstrip is inserted into the slot it is desirable that the weatherstrip be configured so as to enable the weatherstrip to be captured in the slot and movement of the weatherstrip be restricted. Movement of the weatherstrip, especially sidewise or lengthwise thereof, can affect air and water infiltration through the window or door sealed or insulated by the weatherstrip. Reference may be made to Larry E. Johnson, U.S. Pat. No. 5,438,802, issued Aug. 8, 1995, and to International Application No. PCT/US02/16612, published as International Publication No. WO03/100151 on Dec. 4, 2003 for further information as to the insertion of weatherstrip into T-slots and the configuration of weatherstrip in order to effectively capture the weatherstrip in the slot. Such weatherstrips generally use modifications in the profile or shape of the weatherstrip in order to provide interference between the backing of the weatherstrip and the surface of the T-slot. It has been found, in accordance with the invention, that the weatherstrip may be improved without materially changing the profile of the backing, and also in a manner that avoids interference with the insertion of the weatherstrip backing into the slot through the throat thereof, and provides a low cost and effective solution to the capture of the weatherstrip in the slot.

Accordingly, it is a principal object of the present invention to provide a weatherstrip improved to facilitate insertion and capture in a T-slot.

It is still a further object of the present invention to provide improved weatherstrip which may be captured in a T-slot utilizing weatherstrips of the type which is well known and accepted in the industry and which has been manufactured in accordance with accepted manufacturing techniques, such as described in Robert C. Horton, U.S. Pat. No. 4,302,494, issued Nov. 24, 1981, Johnson et al. U.S. Pat. No. 5,338,382, issued Aug. 16, 1994, and Johnson U.S. Pat. No. 5,807,451, issued Sep. 15, 1998, and U.S. Pat. No. 5,817,390, issued Oct. 6, 1998.

It is still a further object of the present invention to provide weatherstrips adapted to be captured in T-slots and constitute improved weatherstrips assemblies of the member having the T-slot and the weatherstrip.

Briefly described, the invention provides an improved weatherstrip having a sealing element on a backing which is capturable in a T-slot with a sealing element projecting out of the slot. The weatherstrip includes a compressible member extending along the backing and adhering thereto. The member and the backing have approximately like thicknesses sufficient to allow the member to be compressed into interfering relationship with the T-slot along an interior surface thereof.

The foregoing and other objects, features and advantages of the invention will become more apparent from a reading of the following description in connection with the accompanying drawings in which.

Figure 8:
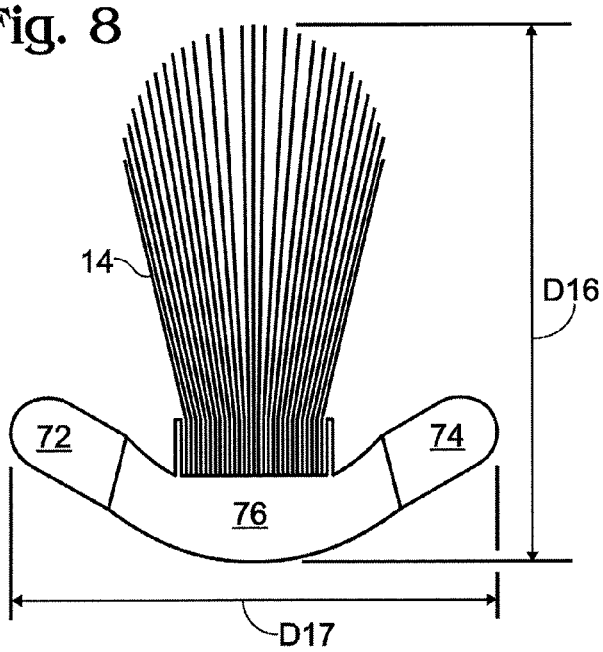
Figure 7:
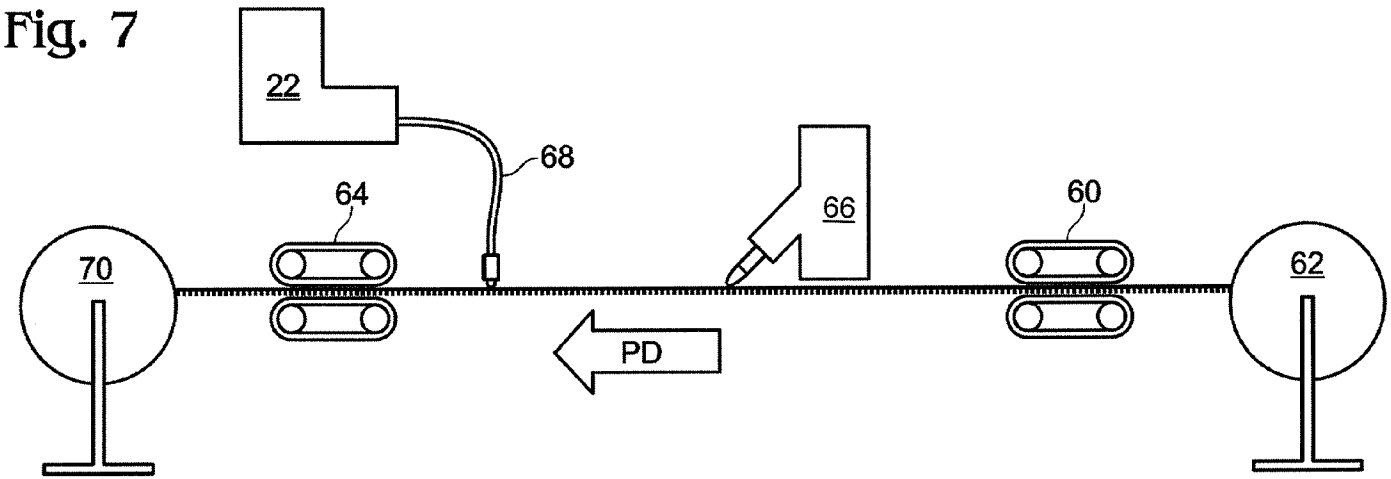

FIG. 7 is a schematic diagram of the process of producing the weatherstrip shown in the preceding figures utilizing a weatherstrip which is manufactured by conventional processes, such as described in the above referenced patents, and is unwound from a payoff reel at the upstream end of the process; and FIG. 8 is an end view of an improved weatherstrip in accordance with another embodiment of the invention.

Figure 1:
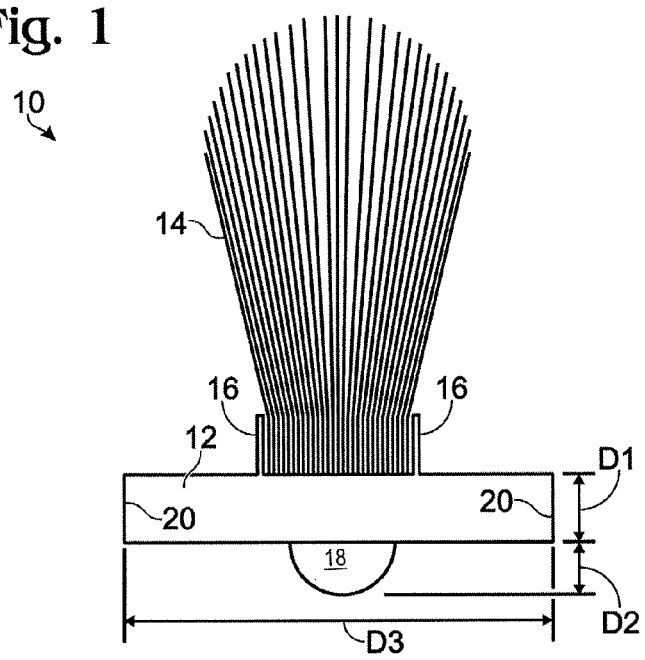
FIG. 1 is an end view of a pile weatherstrip embodying the invention.

Referring to FIG. 1, there is shown a standard pile weatherstrip 10 having a pile sealing element 14, such as made of polypropylene yarn. This pile provides the sealing element of the weatherstrip. The pile 14 is attached, as by ultrasonic welding techniques described in the above referenced patent, on a backing strip 12, preferably of rigid (as compared to the pile 14) polypropylene. The pile 14 may be contained in a channel defined by two longitudinally extending flanges 16 (which may be called "pile directors") on the side of the backing strip 12 on which the pile 14 is attached. On the opposite side of the pile 14 is a bead 18 of compressible material which is centered between the edges 20 of the backing 12 and is attached to the side of the backing opposite to the pile 14. In accordance with a presently preferred embodiment of the material, this bead 18 is solidified hot melt glue, which may be of ethylene vinyl acetate material, which is self-adhering to the backing 12 when extruded thereon from a hot melt heater and pump 22, as shown in FIG. 7. Throughout FIGS.1-8, many exemplary dimension values are indicated by reference characters. Exemplary values for these exemplary dimensions (in inches) are as follows: (i) D1=0.030; (ii) D2=0.035; (iii) D3=0.187; (iv) D4=0.065; (v) D5=0.040; (vi) D6=0.060; (vii) D7=0.187; (viii) D8=0.200; (ix) D9=0.040; (x) D10=0.060; (xi) D11=0.189; (xii) D12=0.200; (xiii) D13=0.040; (xiv) D14=0.060; (xv) D15=0.189; (xvi) D16=0.200; (xvii) D17=0.189.

The bead 18 is of a soft durometer and therefore compressibility and flexibility is much greater than that of the backing 12. For example, the durometer of the bead may be between 50 and 90 (Shore A). For some applications, the durometer may be about 60 (Shore D). The thickness of the backing 12 between the opposite sides thereof and the height of the bead are comparable. This geometry facilitates the insertion of the bead through the opening or throat of the T-slot. When inserted into the T-slot, as will be apparent from FIGS. 5 and 6, the bead 18 compresses along its curved surface and holds the weatherstrip 10 in the T-slot 24.

The use of the compressible bead 18 in accordance with the invention may be extended to weatherstrips having sealing elements other than pile, such as bulbs of hollow plastic sleeve material or foam, as conventionally used in weatherstrips.

The application of the bead 18 in hot melt form is presently preferred. The material providing the bead 18 may be selected from any material which forms a compressible bead with a curved surface for engaging an interior surface of the T-slot 24. See FIG. 5. Other semi-rigid plastic material may be used, preferably material which may be extruded, such as thermoplastic elastomer, hot meltable polyethylene and other hot meltable olefin material. The bead 18 may be co-extruded with the backing 12 so as to provide a backing which may be assembled with the pile by conventional techniques, such as described in the above referenced patents to Horton and Johnson. Co-extrusion techniques are also discussed in U.S. Pat. No. 6,776,948, issued Aug. 17, 2004, to Richard T. Arvidson et al.

The relative sizes of the pile and backing are shown in the figures are for purposes of illustration and are not limiting on how the weatherstripping may be sized.

Figure 2:
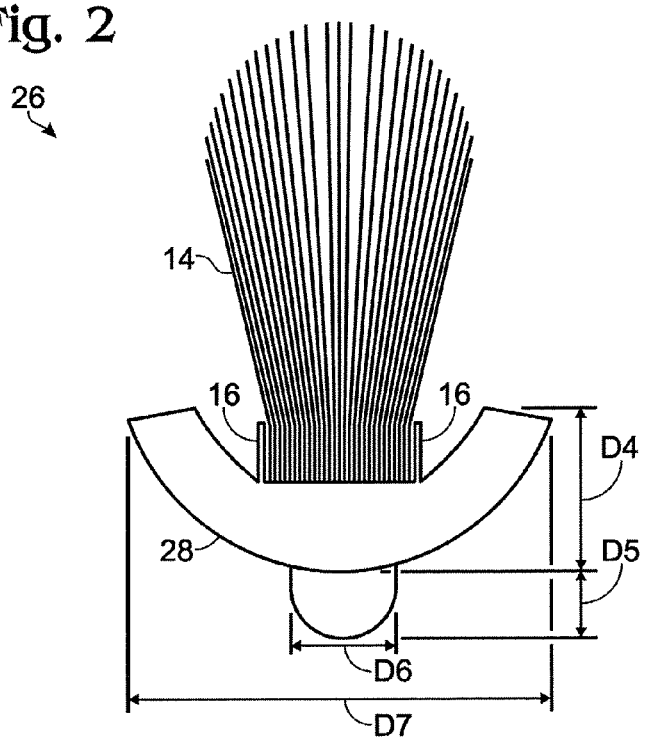
FIG. 2 is an end view of a weatherstrip similar to FIG. 1 having a backing which is arcuate in cross section.
Figure 1A:
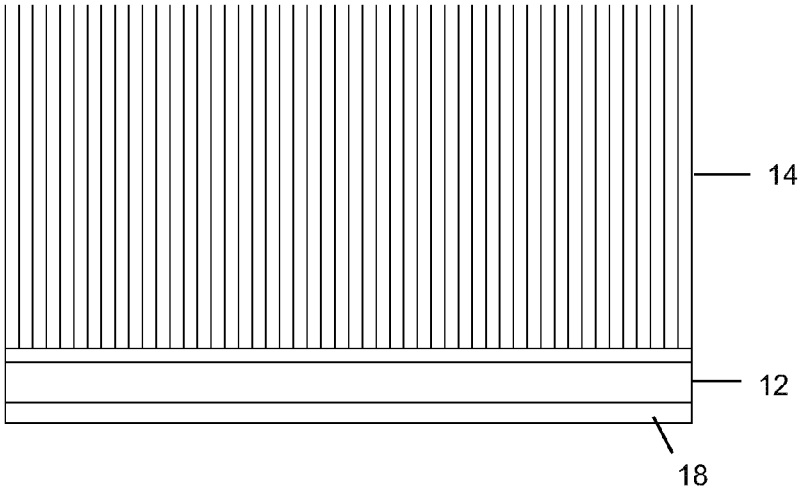
FIG. 1A is a side view of the pile weatherstrip shown in FIG. 1.
Figure 2A:
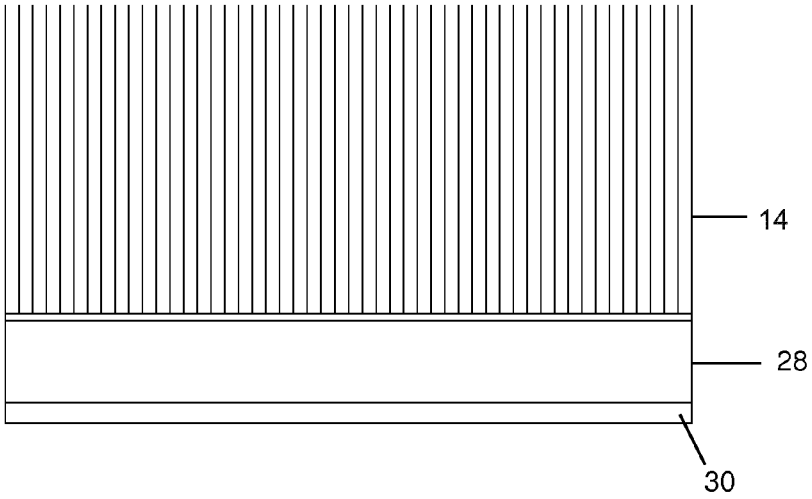
FIG. 2A is a side view of the weatherstrip shown in FIG. 2.

Referring to FIG. 2, there is shown another weatherstrip 26 embodying the invention. A similar pile-sealing element 14 may be used. The backing 28 represents a strip that is curved in cross-section, and the bead 30 has a profile which is generally rectangular at the base and cylindrical or curved at the tip so as to provide an interfering relationship with the interior surface of the T-slot. Edges of the backing 28 may be inclined so as to facilitate the fitting thereof against the inside surface of the T-slot 24 which forms the side walls and roof thereof adjacent to the throat or opening of the T-slot 24. See FIG. 5.

Figure 4:
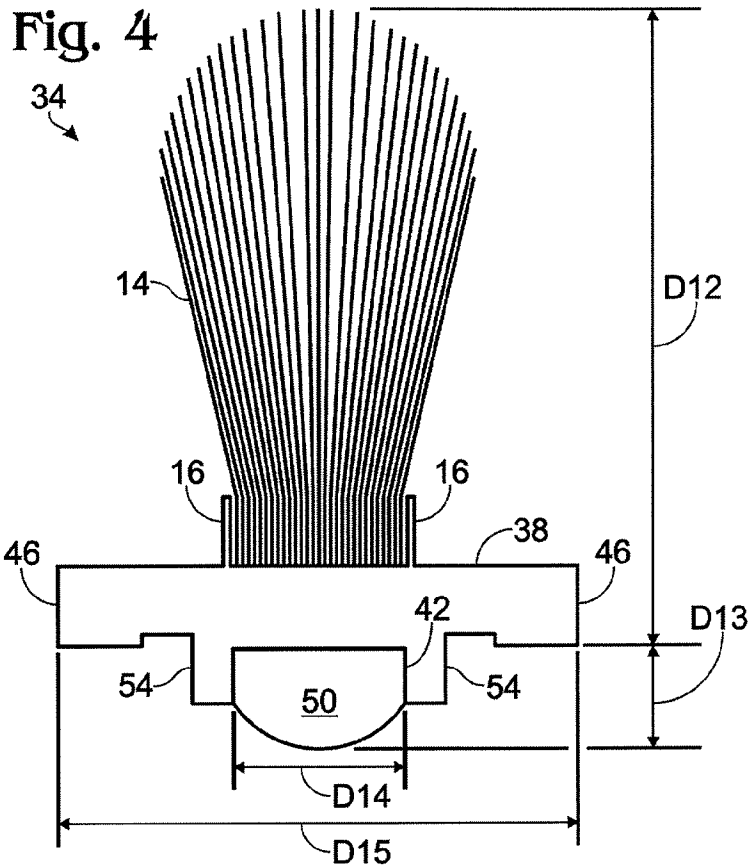
FIG. 4 is an end view similar to FIG. 3 where the channel is formed by upsetting the outside of the surface of the backing opposite to the surface from which the pile sealing element extends.
Figure 3:
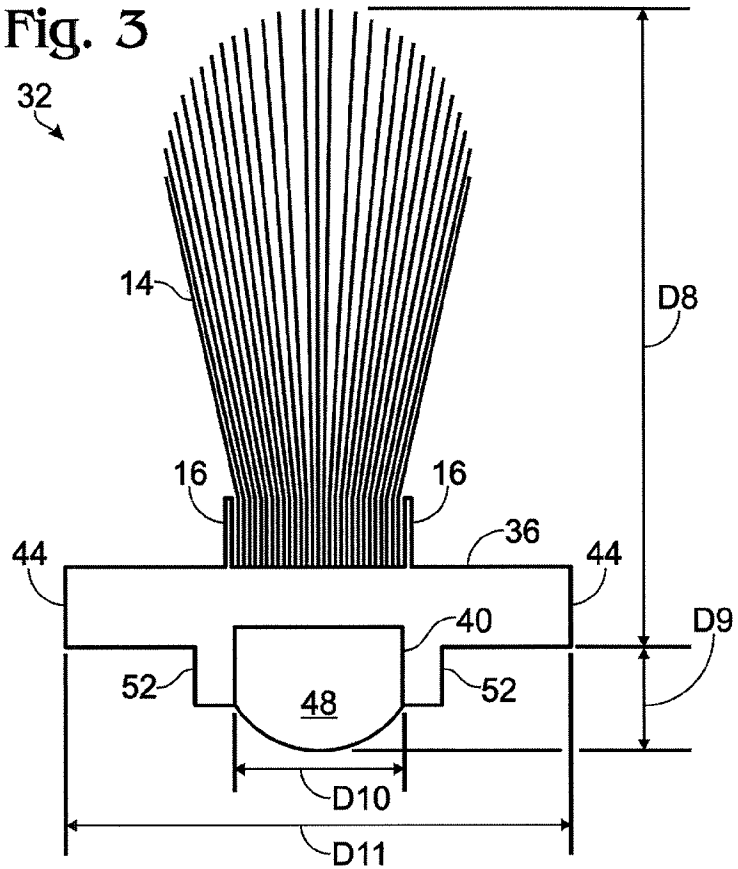
FIG. 3 is an end view of a weatherstrip similar to FIG. 1 where the backing is provided with a channel formed by upsetting the inside of the backing on the side thereof opposite to the pile sealing element.
Figure 3A:
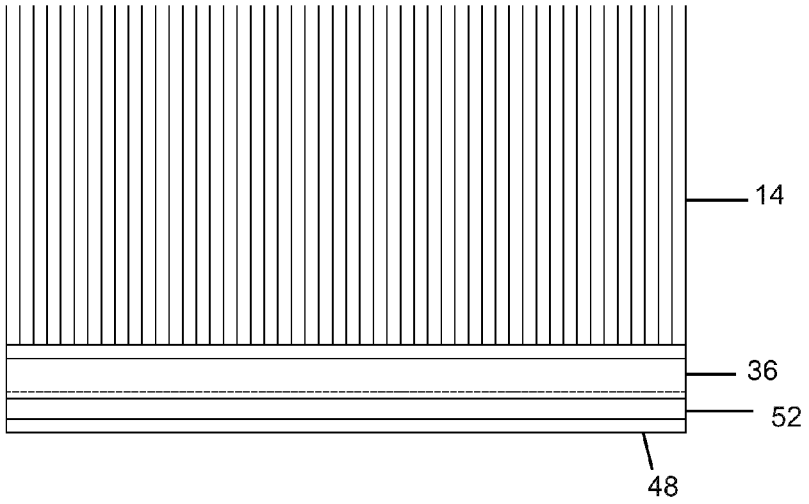
FIG. 3A is a side view of the weatherstrip shown in FIG. 3.
Figure 4A:
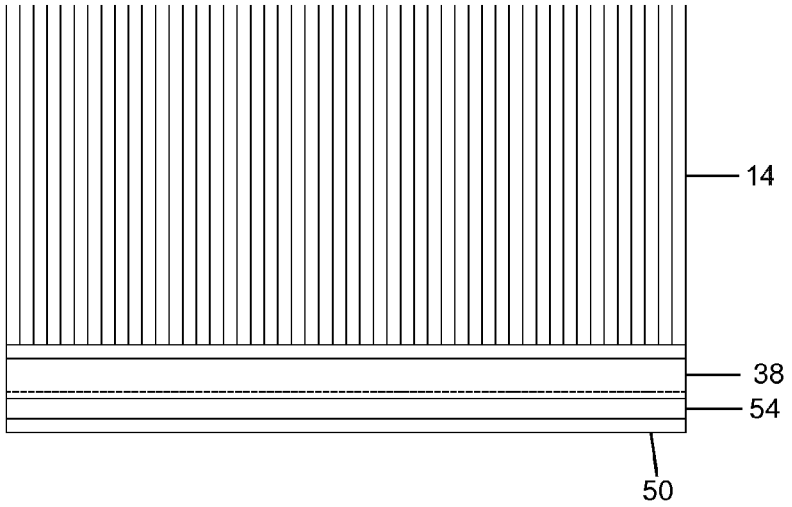
FIG. 4A is a side view of the weatherstrip shown in FIG. 4.

Referring to FIGS. 3 and 4, there is shown weatherstrips 32 and 34 having backings 36 and 38 with channels 40 and 42 running lengthwise of the backings 36 and 38 and centered between the edges 44 and 46 thereof. The channels 40 and 42 provide receptacles for the glue beads 48 and 50, respectively, and facilitate the deposition of the beads as from a hot melt heater and pump arrangement 22, as shown in FIG. 7. The weatherstrip 32 and 34 both have their channels 40 and 42, respectively, made by upsetting the material along the bottom side of the backing 36 opposite to the pile 14 by means of a plow which forms the flanges 52 and 54 of the channels 40 and 42, respectively. In case of the weatherstrip 32, the channel 40 is formed by a plow which runs centrally along the backing 36 and upsets the flanges from the inside of the weatherstrip. Such a plow arrangement is shown in the above referenced Horton patent. In the case of weatherstrip 34, channel 54 is formed by an outside plow arrangement, such as shown in the above referenced International Patent Publication, may be used to upset the surface of the backing 38 opposite to the surface from which the pile 14 extends.

Figure 5:
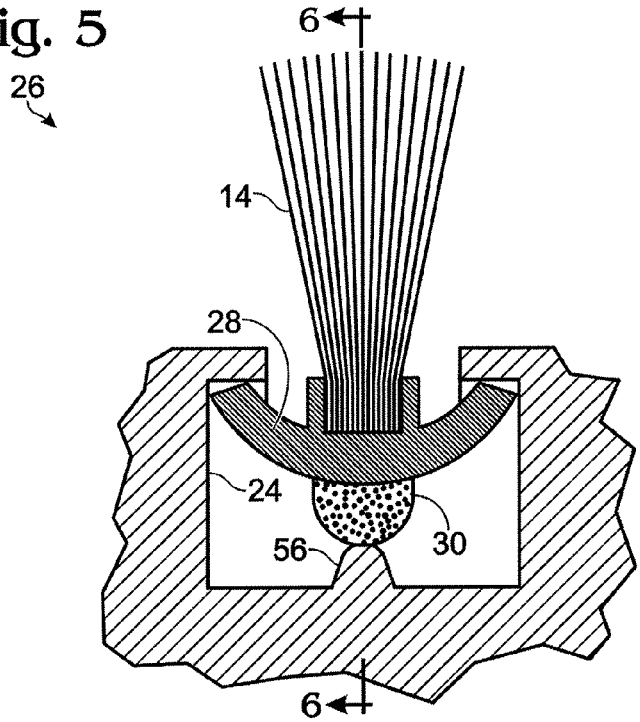
FIG. 5 is a cross-sectional view taken along the line 5-5 in FIG. 6 of a weatherstrip in accordance with the invention, captured in a T-slot modified to facilitate compression of a bead to restrict movement of the weatherstrip in a direction lengthwise thereof as well as edgewise.
Figure 6:
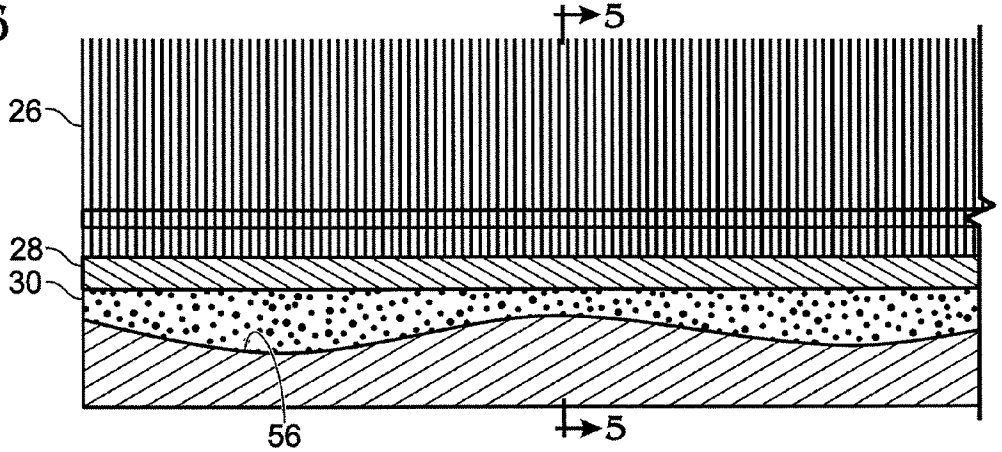
FIG. 6 is a fragmentary sectional view of the weatherstrip assembly shown in FIG. 5 taken along the line 6-6 in FIG. 5.

Referring more particularly to FIGS. 5 and 6, the T-slot 24 is shown as having a ridge 56 which may have a variable height profile so that it forms a wave-like, undulating surface in its cross section as shown in FIG. 6. When the weatherstrip 26 is inserted into the T-slot 24, the bead 30 becomes compressed against the ridge 56; filling the undulations in the surface thereof. There is therefore provided resistance against lengthwise as well as sidewise movement of the weatherstrip 26, since it is firmly captured in the T-slot 24.

As shown in FIG. 7, a completed weatherstrip may be pulled by puller belts 60 from a pay-off reel 62 in the direction of arrow PD. Another set of puller belts 64 maintains tension in the weatherstrip against a plow 66, which upsets the backing from the inside or outside to form the central channel, as shown in FIG. 3 or 4, respectively. The hot melt heater pump 22 deposits the bead into the channel via a hose 68. The bead cools and solidifies quickly. Sufficient time for cooling in the process is provided due to the distance between the puller 64 and the nozzle of the pump 22. The bead therefore solidifies into the shape as shown in FIGS. 3 and 4 before being wound up on the winder reel 70 which may be removed and shipped to the customer. To provide the bead 18 of FIG. 1, plow 66 is not provided in FIG. 7.

Referring to FIG. 8, other embodiments of the invention may include a pair of compressible beads 72 and 74 along the edges of a rigid polypropylene backing 76 which may be co-extruded with the material of the bead, such for example as a flexible polypropylene (e.g., a polypropylene and EPDM composite, 65 durometer thermoplastic elastomer) while the remainder of the backing is rigid polypropylene of the type such as used in conventional weatherstrips. Other embodiments may be provided with the beads deposited at various staggered positions on the side of the backing opposite to the sealing element or pile 14, or in an undulating pattern along the opposite side surface of the backing.

Other various and modifications of the weatherstrip, in addition to those discussed above, may be provided in accordance with the invention. The dimensions of the weatherstrips shown in FIGS. 1-4 and 8 are exemplary; other dimensions may be used for such weatherstrips in accordance with the particular T-slot into which the weatherstrips will be received. Accordingly the foregoing description should be taken as illustrative and not in a limiting sense.

The invention claimed is:

1. A weatherstrip system, the system comprising:

an elongated support member T-slot adapted to receive a weatherstrip assembly, the T-slot defining a first lateral direction, a second lateral direction, and a depth direction, the T-slot including a set of two lips defining a top opening, a first lateral interior surface perpendicular to said lips, a second lateral interior surface perpendicular to said lips, and a bottom surface; and a weatherstrip assembly adapted for insertion into said elongated support member T-slot, the weatherstrip assembly comprising:

a backing member;

a weatherblocking member set comprising at least one weatherblocking member; and a flexible member;

wherein:

the backing member is elongated to define a longitudinal direction;

the backing member includes a first lateral-extending portion, a second lateral-extending portion, a top side and a bottom side;

the weatherblocking member set is connected to the top side of the backing member so that when the weatherstrip assembly is inserted into the T-slot, the weatherblocking member set will extend outwards from the T-slot;

the backing member is structured and shaped so that when the backing member is inserted into the T-slot the first lateral-extending portion will extend to contact the first lateral interior surface of the T-slot, and the second lateral-extending portion will extend to contact the second lateral interior surface of the T-slot;

the flexible member is connected to the bottom side of the backing member and extends continuously along an entire longitudinal length of the backing member; and the flexible member is structured and shaped so that when the backing member is inserted into the T-slot the flexible member will compressively flex within a space between the bottom side of the backing member and the bottom surface of the T-slot so that the compressive flexing of the flexible member will force the backing member in a direction opposite the depth direction so that the backing member is forced into contact, along the entire longitudinal length of the backing member, with the set of lips of the T-slot;

the backing member and the flexible member are made of different materials, and wherein the flexible member is more flexible than the backing member.

2. The system of claim 1 wherein the weatherblocking member set is a set of pile members.

3. The system of claim 1 wherein the flexible member is made of solidified hot melt glue.

4. The system of claim 3 wherein the flexible member is made of ethylene vinyl acetate.

5. The system of claim 1 wherein the flexible member is self-adhering to the backing member.

6. The system of claim 1 wherein the flexible member is located only under a central portion of the bottom surface of the backing member and does not extend laterally over the first-lateral-extending portion of the backing member or the second-lateral-extending portion of the backing member.

* * * * *